US005922667A

United States Patent [19]

van Baggem et al.

[11] Patent Number: 5,922,667

[45] Date of Patent: Jul. 13, 1999

[54] CLEANING GELS

[75] Inventors: Eduard C. van Baggem; Norman Jason Pritchard; Gijsbertus de Goederen; Ruben E. M. J. Jakobs, all of Maarssen, Netherlands

[73] Assignee: Diversey Lever, Inc., Plymouth, Mich.

[21] Appl. No.: 08/818,190

[22] Filed: Mar. 14, 1997

[30] Foreign Application Priority Data

Mar. 15, 1996 [EP] European Pat. Off. ..... 96200715

[51] Int. Cl.[6] ..... C11D 3/26; C11D 1/02; C11D 17/00

[52] U.S. Cl. ..... 510/403; 510/197; 510/218; 510/405; 510/481; 510/492; 510/498; 510/499; 510/504

[58] Field of Search ..... 510/403, 405, 510/481, 492, 498, 499, 504, 197, 218

[56] References Cited

U.S. PATENT DOCUMENTS 4,414,128 11/1983 Goffinet ..... 510/405
5,246,629 9/1993 Fukumoto et al. ..... 510/427
5,700,331 12/1997 Thomas et al. ..... 134/29

FOREIGN PATENT DOCUMENTS 1 151 501 8/1983 Canada .
94/25561 11/1994 WIPO .

OTHER PUBLICATIONS

European Search Report dated Aug. 14, 1996.

*Primary Examiner*—Anthony Green

[57] ABSTRACT

The invention relates to a cleaner concentrate composition which can be diluted to form a viscous use solution, the cleaner composition comprising:

an ammonium compound and/or an amphoteric compound; and an anionic surfactant, wherein the composition is free of amine oxide.

13 Claims, 1 Drawing Sheet

CLEANING GELS

FIELD OF THE INVENTION

The present invention concerns cleaning compositions, and more specifically cleaning compositions which can be diluted in order to provide cleaning gels.

BACKGROUND OF THE INVENTION

For the cleaning of hard surfaces and objects, particularly in industrial, institutional and catering environments, cleaning products in the form of gels, which have a prolonged contact with the target surface to be cleaned, are known.

A problem with known gels is that they comprise amine oxide as a gelling agent, which is environmentally harmful, for example by forming nitrosoamines.

An object of the present invention is to yield a gel cleaner, free of amine oxide.

The inventors have surprisingly found that said object can be achieved by applying an ammonium compound, preferably a quaternary or a ternary ammonium compound instead of amine oxide as a gelling agent, and that said ammonium compound can be used to yield an effective cleaning gel.

SUMMARY OF THE INVENTION

According to a first aspect of the present invention, there is provided a cleaner concentrate composition which can be diluted to form a viscous use solution, the cleaner composition comprising:

an ammonium compound and/or an amphoteric compound; and an anionic surfactant, wherein the composition is free of amine oxide.

Since this cleaner composition is free of amine oxide, environmentally harmful effects are reduced.

A second aspect of the present invention provides a cleaning method comprising the steps of diluting a concentrate composition according to the invention with water to a concentration to yield a desired viscosity and applying the composition thus diluted to a target surface.

Further aspects of the present invention provide a cleaning gel obtainable by diluting with water the concentrate composition of the invention, and the use of said cleaning gel for cleaning target surfaces.

DETAILED DESCRIPTION OF THE INVENTION

When in use for cleaning a surface, the cleaner concentrate composition of the present invention is desirably diluted with water to a concentration of from 1 to 20%, preferably from 2 to 10%, by weight, so as to yield a cleaning gel having a suitable viscosity. Particularly when cleaning verticle surfaces, said cleaning gel should have sufficient viscosity for obtaining effective cleaning performance.

The ammonium compound present in the composition of the invention is effectively a quaternary or a ternary ammonium compound. More preferably, said ammonium compound is selected from the group consisting essentially of benzalkonium chloride and primary, secondary or tertiary amines ($C_{12}$–$C_{27}$).

If a quaternary ammonium compound is used, it has desirably a chain length of $C_8$–$C_{20}$, preferably $C_{12}$–$C_{16}$.

A tertiary amine is effectively present for obtaining viscous use solution having a pH-value of 9.5–10, whereas a secondary amine is suitably used when a viscous use solution having a pH of 3.5–4.0 is needed.

The ammonium compound is preferably present at a concentration of from 1 to 25%, more preferably from 1 to 10%, by weight of the concentrate composition of the invention.

Preferably, the anionic surfactant present in the concentrate composition of the invention consists one or more fatty acids neutralized by an alkaline source, preferably an alkaline metal salt such as a sodium salt, these forming a soap. Effectively, said anionic surfactant includes saturated and unsaturated fatty acids in a weight ratio of 1:5, preferably 1:2. Preferably, the fatty acids are selected from the group consisting essentially of oleic acid, palmitic acid, caprylic acid and isostearic acid. The alkaline source is preferably present in the concentrate composition of the invention at a concentration of 5 to 40% by weight.

Desirably, the concentrate composition of the present invention further comprises a cleaning agent selected from the group consisting of a secondary alkane sulphonate, an alkane sulphate, an ether sulphate, and mixtures thereof. More preferably, the concentrate composition of the invention includes a secondary alkane sulphonate at a concentration of from 1 to 25% by weight.

In order to boost the cleaning performance thereof, the concentrate composition of the invention may effectively further comprise a noaninic surfactant.

A suitable further component of the concentrate composition of the invention is a solvent, which can be effectively used for establishing the desired viscosity of the use solution to be obtained from said concentrate by dilution. Said solvent is preferably selected from the group consisting of isopropanol, ethanol, hexylene glycol, propylene glycol, diethylene glycol, monoethyl/butyl ether, dioxital butyl dioxital, and mixtures thereof.

A further preferred component of the concentrate composition of the invention is a sequestrant, said sequestrant being desirably present therein at a level of 0.1 to 15% by weight. Said sequestrant is preferably selected from the group consisting of ethylene-diamine-tetraacetic acid, nitrilo-trioacetic acid, citric acid, methyl-glycine-diacetic acid, serine diacetic acid, alkaline salts thereof, and mixtures thereof.

The concentrate composition of the invention may effectively further include threshold agents such as phosphonates, polyacrylates and hydrotropes, and/or iron binders such as sodium gluconate. These threshold agents and iron binders may be suitably present at a concentration of from 0.1 to 5% by weight.

The concentrate composition preferably has a flash point of between 25–50° C.

The present invention will now be illustrated by way of the following examples.

Field trials have been carried out with the following embodiments of a composition according to the present invention.

Figure 1:
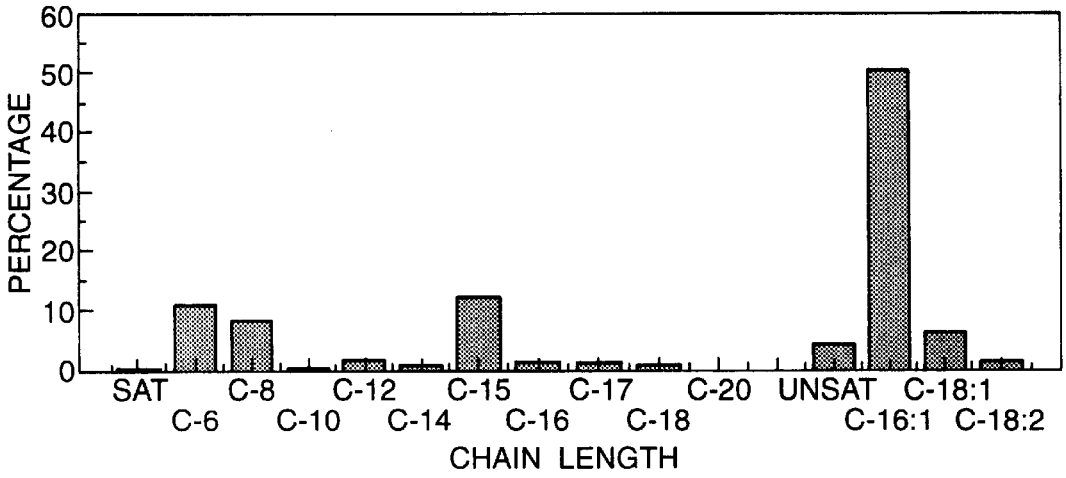
FIGS. 1–3 show the measured ratio of saturated to unsaturated fatty acids of compositions 1 to 3 respectively.
Figure 2:
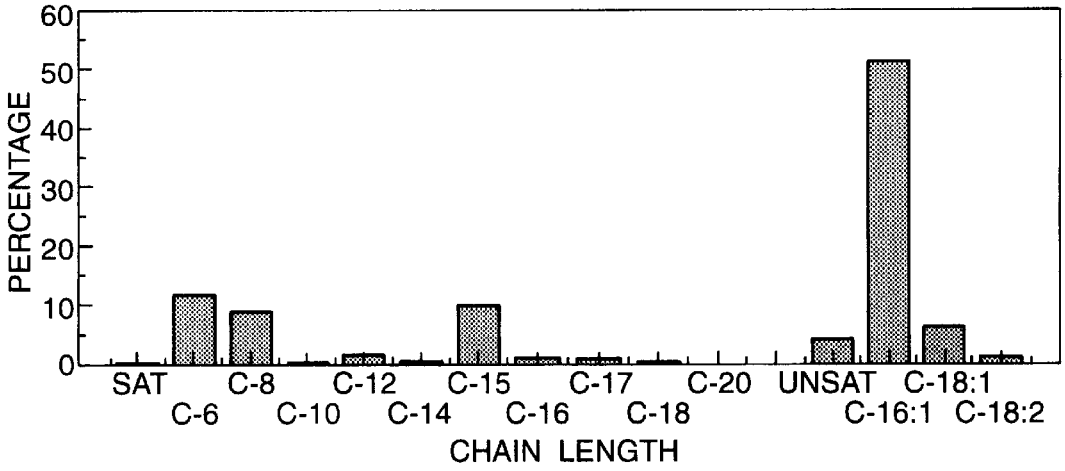
Figure 3:
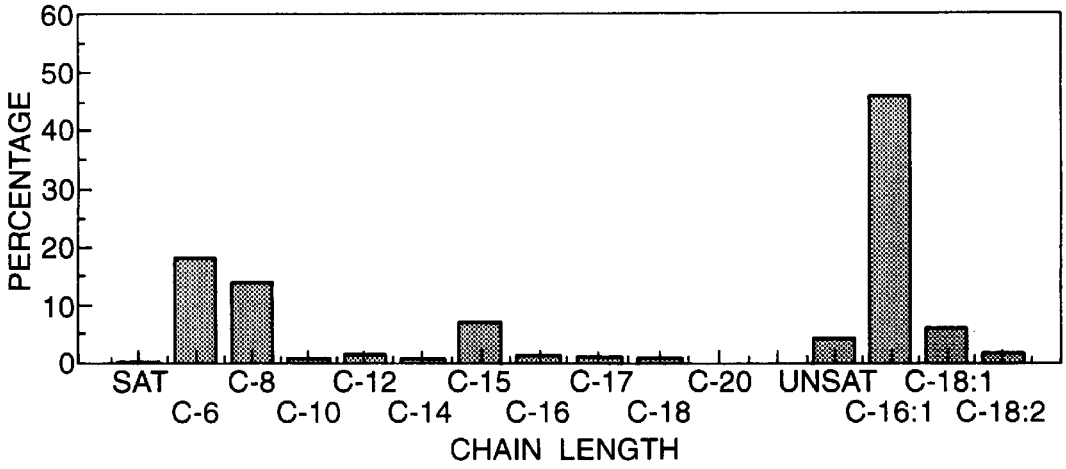

Composition 1: General purpose liquid detergent for foamgel and gel cleaning (low flash point).

| Raw material | % as supplied | as 100% |
|---|---|---|
| (2) potassium hydroxide (50%) | 12.00 | 6.00 |
| (3) ethanol | 10.00 | 10.00 |
| (4) palmitic acid | 0.75 | 0.75 |
| (5) oleic acid | 5.50 | 5.50 |
| (6) caprylic acid | 1.50 | 1.50 |
| (7) gluconic acid Na-salt | 0.50 | 0.50 |
| (8) alkane suphonic acid Na-salt (30%) | 1.50 | 0.30 |
| (9) cumene sulphonic acid Na-salt (40%) | 14.00 | 4.00 |
| (10) alkyl dimethyl benzyl ammonium chloride (50%) | 3.00 | 1.50 |
| (11) ethylene diamine tetraacetic acid 4 Na-salt (40%) | 10.00 | 4.00 |
| (12) sodium hydroxide (50%) | 4.00 | 2.00 |
| (1) water (demineralised) up to | 100.00 | 100.0 |

Production Method of Composition 1

The raw materials were mixed together in the order given in brackets.

Characteristics of composition 1

Appearance: light yellow colored clear viscous liquid

Relative density (20° C.): 1.09

Viscosity:

Neat product: 50–100 mPa.s at 21 $s^{-1}$ (Haake MV1 25° C.)

4% solution: >120 mPa.s at 21 $s^{-1}$ (Haake MV1 25° C.)

pH (1% solution): 12.3–12.5

Active alkalinity to pH 8.2 (phenophtalein): 4.2–4.6as $Na_2O$

Total alkalinity to pH 3.6 (methyl orange): 5.4–5.8% as $Na_2O$

Composition 2: Heavy duty liquid detergent for foamgel and gel cleaning (low flash point).

| Raw material | % as supplied | as 100% |
|---|---|---|
| (2) potassium hydroxide (50%) | 24.00 | 12.00 |
| (3) ethanol | 10.00 | 10.00 |
| (4) palmitic acid | 0.50 | 0.50 |
| (5) oleic acid | 5.25 | 5.25 |
| (6) caprylic acid | 1.50 | 1.50 |
| (7) gluconic acid Na-salt | 0.50 | 0.50 |
| (8) alkane suphonic acid Na-salt (30%) | 1.50 | 0.45 |
| (9) cumene sulphonic acid Na-salt (40%) | 2.00 | 0.80 |
| (10) alkyl dimethyl benzyl ammonium chloride (50%) | 2.25 | 1.13 |
| (11) ethylene diamine tetraacetic acid 4 Na-salt (40%) | 10.00 | 4.00 |
| (12) sodium hydroxide (50%) | 6.00 | 3.00 |
| (1) water (demineralised) to | 100.00 | 100.0 |

Production Method of Composition 2

The raw materials were mixed together in the order given in brackets. The plant must be suitable for readily foamable products.

Characteristics of composition 2

Appearance: light yellow colored clear viscous liquid

Relative density (20° C.): 1.13

Viscosity: Neat product: 50–100 mPa.s at 21 $s^{-1}$ (Haake MV1 25° C.)

4% solution: >120 mPa.s at 21 $s^{-1}$ (Haake MV1 25° C.)

pH (1% solution): 12.5–12.7

Active alkalinity to pH 8.2 (phenophtalein): 8.0–8.5% as $Na_2O$

Total alkalinity to pH 3.6 (methyl orange): 9.2–9.6% as $Na_2O$

Composition 3: Heavy duty liquid detergent for foamgel and gel cleaning of ovens and smoke chambers (low flash point).

| Raw material | % as supplied | as 100% |
|---|---|---|
| (2) potassium hydroxide (50%) | 32.50 | 16.25 |
| (3) ethanol | 10.00 | 10.00 |
| (4) palmitic acid | 0.35 | 0.35 |
| (5) oleic acid | 5.50 | 5.50 |
| (6) caprylic acid | 2.75 | 2.75 |
| (7) gluconic acid Na-salt | 0.50 | 0.50 |
| (8) alkane suphonic acid Na-salt (30%) | 1.50 | 0.45 |
| (9) cumene sulphonic acid Na-salt (40%) | 1.00 | 0.40 |
| (10) alkyl dimethyl benzyl ammonium chloride (50%) | 2.25 | 1.12 |
| (11) ethylene diamine tetraacetic acid 4 Na-salt (40%) | 5.00 | 2.00 |
| (12) sodium hydroxide (50%) | 7.00 | 3.50 |
| (1) water (demineralised) to | 100.00 | 100.0 |

Production Method of Composition 3

The raw materials were mixed together in the order given in brackets. The plant must be suitable for readily foamable products.

Characteristics of composition 3

Appearance: light yellow colored clear viscous liquid

Relative density (20° C.): 1.15

Viscosity:

Neat product: 50–100 mPa.s at 21 $s^{-1}$ (Haake MV1 25° C.)

4% solution: >120 mPa.s at 21 $s^{-1}$ (Haake MV1 25° C.)

pH (1% solution): 12.5–12.7

Active alkalinity to pH 8.2 (phenophtalein): 9.7–10.1% as $Na_2O$

Total alkalinity to pH 3.6 (methyl orange): 10.7–11.1% as $Na_2O$

We claim:

1. A cleaner composition which can be diluted to form a viscous use solution, the cleaner composition comprising:

a) 1 to 25% by weight of an ammonium compound selected from the group consisting of benzalkonium chloride, a $C_{12}$–$C_{27}$ primary, secondary or tertiary alkyl amine, and mixtures thereof; and b) an anionic surfactant consisting of at least one fatty acid neutralized by an alkaline source, the alkaline source being present in the composition at a concentration of 5 to 40% by weight.

2. The composition in accordance with claim 1 which on dilution with water forms a gel comprising the composition at a concentration of 1–20% by weight.

3. The composition in accordance with claim 1 wherein the benzalkonium chloride has a $C_8$–$C_{20}$ hydrocarbon chain.

4. The composition in accordance with claim 1 wherein the alkylamine is secondary for a composition pH of 3.5–4.0 or tertiary for a composition pH of 9.5–10.0.

5. The composition in accordance with claim 1 wherein the anionic surfactant consists of more than one fatty acid at a ratio of one saturated fatty acid for every five unsaturated fatty acids.

6. The composition in accordance with claim 5 wherein the unsaturated fatty acids are oleic acid, and the saturated fatty acid is selected from the group consisting of palmitic acid, caprylic acid, iso–stearic acid, and mixtures thereof.

7. The composition in accordance with claim 1 further comprising 1 to 25% by weight of a secondary alkane sulphonate.

8. The composition in accordance with claim 1 further comprising a solvent selected from the group consisting of isopropanol, ethanol, hexylene glycol, propylene glycol, diethylene glycol, monoethylether, monobutylether, dioxitol, butyldioxitol and mixtures thereof.

9. The composition in accordance with claim 1 wherein the composition has a flash point of between 25–50° C.

10. The composition in accordance with claim 1 further comprising 0.1 to 15% by weight of a sequestrant selected from the group consisting of ethylene diamine tetraacetic acid, nitrilo-triacetic acid, citric acid, methyl glycine diacetic acid, serine diacetic acid, alkaline salts thereof and mixtures thereof.

11. The composition in accordance with claim 1 wherein the composition is free of amine oxide.

12. The composition in accordance with claim 1 wherein the ammonium compound is a quaternary or ternary ammonium compound.

13. A method for cleaning a surface comprising the steps of:

a) forming a cleaner composition which may be diluted to form a viscous solution, the cleaner composition comprising:

(i) 1 to 25% by weight of an ammonium compound selected from the group consisting of benzalkonium chloride, a $C_{12}$–$C_{27}$ primary, secondary or tertiary alkyl amine, and mixtures thereof;

ii) an anionic surfactant consisting of one or more fatty acids neutralized by an alkaline source, the alkaline source being present in the composition at a concentration of 5 to 40% by weight;

b) diluting the composition with water to form a gel containing the composition at a concentration of from 1–20% by weight; and c) applying the gel to the surface to be cleaned.

* * * * *